US008016949B2

(12) United States Patent
Jayaraman et al.

(10) Patent No.: US 8,016,949 B2
(45) Date of Patent: Sep. 13, 2011

(54) PROCESS AND A DEVICE TO CLEAN SUBSTRATES

(75) Inventors: Suresh Sambamurthy Jayaraman, Bangalore (IN); Kirtan Shravan Kamkar, Bangalore (IN); Lalit Kumar, Bangalore (IN); Amit Sah, Bangalore (IN); Rudra Saurabh Shresth, Bangalore (IN)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 12/867,261

(22) PCT Filed: Jan. 27, 2009

(86) PCT No.: PCT/EP2009/050869

§ 371 (c)(1),
(2), (4) Date: Aug. 12, 2010

(87) PCT Pub. No.: WO2009/103595

PCT Pub. Date: Aug. 27, 2009

(65) Prior Publication Data

US 2010/0307541 A1 Dec. 9, 2010

(30) Foreign Application Priority Data

Feb. 21, 2008 (IN) ..... 0373/MUM/2008

(51) Int. Cl.
*B08B 3/02* (2006.01)

(52) U.S. Cl. ..... 134/36; 134/26; 134/34; 134/42; 134/95.3; 134/99.1; 134/103.2; 134/198; 68/205 R; 239/8; 239/10; 239/11; 239/423; 239/424; 239/433; 239/434.5

(58) Field of Classification Search ..... 239/8, 10, 239/11, 423, 424, 433, 434.5; 68/205 R; 134/26, 34, 36, 42, 95.3, 99.1, 103.2, 198
See application file for complete search history.

(56) References Cited

U.S. PATENT DOCUMENTS 4,127,913 A 12/1978 Monson ..... 15/321

(Continued)

FOREIGN PATENT DOCUMENTS

EP 1 737 025 12/2006

(Continued)

OTHER PUBLICATIONS

PCT International Search Report in PCT application PCT/EP2009/050869 dated Apr. 9, 2009.

(Continued)

*Primary Examiner* — Sharidan Carrillo
(74) *Attorney, Agent, or Firm* — Rimma Mitelman

(57) ABSTRACT

In particular a porous substrate (FS) like a fabric. Process to clean a substrate, comprising a step of subjecting the substrate to an air-water spray (SPR), generated using a spraying means (N) comprising an air passage (OPA) and a water passage (OPW), wherein air is greater than 90% by volume of the spray, the air velocity is greater than 80 m/s and wherein said air passage does not coaxially surround said water passage. Device to clean soiled fabric (FS) comprising a feed water container (CW) and an air compressor (AC) in fluid communication with a spray nozzle (N) comprising an air passage and a water passage, said device being capable of generating an air pressure in the range of 1 to 3 bar (absolute) and an air velocity greater than 80 m/s at the exit of said nozzle; and the air is greater than 90% volume of said spray, and wherein said air passage does not coaxially surround said water passage. An external mix spray nozzle is especially preferred in the device.

7 Claims, 3 Drawing Sheets

U.S. PATENT DOCUMENTS

| | | | | |
|---|---|---|---|---|
| 4,787,404 | A | 11/1988 | Klosterman et al. | 134/198 |
| 5,001,806 | A | 3/1991 | Gurstein | 15/322 |
| 6,386,466 | B1 | 5/2002 | Ozawa et al. | 239/433 |
| 7,021,571 | B1 | 4/2006 | Lawson et al. | 239/601 |
| 2002/0059947 | A1 | 5/2002 | Sato et al. | 134/102.1 |
| 2002/0189641 | A1 | 12/2002 | Sato | 134/6 |
| 2003/0205631 | A1 | 11/2003 | Barron et al. | 239/690 |
| 2004/0087158 | A1 | 5/2004 | Izumi et al. | 438/689 |
| 2008/0135639 | A1* | 6/2008 | Winters | 239/8 |

FOREIGN PATENT DOCUMENTS

| | | |
|---|---|---|
| FR | 1014273 | 8/1952 |
| FR | 1108989 | 1/1956 |

OTHER PUBLICATIONS

EP Search Report in an EP application EP 08 15 4778.

Abstract of JP 03 296475—published Dec. 27, 1991.

* cited by examiner

PROCESS AND A DEVICE TO CLEAN SUBSTRATES

TECHNICAL FIELD

The invention relates to a process and a device for cleaning of various substrates. The invention has been developed primarily for cleaning of fabrics and will be described hereinafter with reference to this application. However, it will be appreciated that the invention is not limited to this particular field of use.

BACKGROUND AND PRIOR ART

Any discussion of the prior art throughout the specification should in no way be considered as an admission that such prior art is widely known or forms part of the common general knowledge in the field.

There are many methods which have been reported for cleaning surfaces of articles. The method which is chosen to clean a particular surface depends on the nature of soil, the nature of substrate and its surface, and the degree of cleanliness required. The substrates can have porous or non-porous surfaces. Examples of substrates with non-porous surfaces include wood, ceramic, stone, china clay, glass, metals, alloys, semiconductors in the computer industry etc. Materials having porous surfaces include materials made of natural fibers e.g. cotton, silk and materials made of synthetic fibers e.g. polyesters, nylons, acrylics and polyolefins and combinations of natural and synthetic fibers. Natural and synthetic fibers are primarily made into personal clothing, carpets, and upholstery. All of the above materials get soiled as they are used and need cleaning to make it presentable and healthy for the user. The methods used to clean substrates with porous surfaces have generally been different from the methods used to clean non-porous surfaces.

Substrates with non-porous surfaces have generally been cleaned using mechanical/physical methods like scrubbing, buffing, abrasion, ultrasonication or use of chemical methods such as use of surfactants, solvents, acids, alkalis, bleaches and enzymes. Porous surfaces e.g. those of fabrics have generally been cleaned with a combination of chemical and mechanical methods e.g. the fabric is agitated in the presence of a surfactant.

Sprays which are either high speed liquids e.g. water or a combination of water and air have generally been used to clean hard and non-porous surfaces e.g. cleaning automobiles, walls of buildings, metal vessels. Sprays have also been reported to clean semiconductors in the computer industry.

U.S. Pat. No. 4,787,404 (IBM, 1988) disclosed a low flow-rate pressure atomizer device which is so dimensioned and operated as to accelerate a gas to substantially sonic velocity and cause it to break up a cleaning liquid also input at a high pressure into small droplets and accelerate these droplets to at least half the velocity of said gas to create shear stress at a surface adjacent the exit end of said device, thereby to remove the contaminants or the like from said surface.

These and similar devices are directed to cleaning semiconductors and are too complex in design to enable cleaning of everyday objects by a lay consumer. Further the present inventors have determined that the cleaning is not as effective and can be improved further.

Various spray systems have also been reported to clean fabrics. U.S. Pat. No. 4,127,913 (Monson, 1978) describes a fabric cleaning device having a container for cleaning solution, a movable tank for waste water and a cleaning head removably attached to the tank by a vacuum hose for cleaning the fabric. This device requires electric power and a source of pressurized water. Water from the container is directed through a hose to a discharge nozzle mounted in the cleaning head which selectively rinses dirt and cleaning fluid from the fabric. The vacuum pump draws the resulting mixture of cleaning fluid, water and dirt from the fabric and conveys it through the cleaning head to the tank. This system is directed to industrial cleaning where the fabric after treatment with the cleaning solution requires additional equipments for removal of the dirty water by means of vacuum.

An equipment, having similar limitations has been disclosed in U.S. Pat. No. 5,001,806 (US Products, 1991). The fabric cleaning apparatus here includes a vacuum hose and a liquid spray nozzle provided on a universal head support for accepting any one of a series of different sized and/or shaped cleaning head attachments, each being adapted for a particular fabric cleaning function.

US2003205631 (Procter and Gamble) discloses a method and equipment for applying a liquid product onto a household article or plant for purpose of cleaning, wetting, coating, polishing, fabric treatment, plant watering and the like, the method comprising discharging the liquid through a spray nozzle in the form of an upwardly or downwardly directed spray of droplets having an average droplet size of at least about 40 microns and at a proximal distance of from about 0.1 to about 1 m from the household article or plant, the liquid being discharged through the spray nozzle at an exit velocity in the range from about 3 to about 80 m/s and at an applied potential in the range from about 0.2 to about 50 kV, whereby the overspray is less than about 40%. The equipment preferably comprises a nozzle having a multi-jet spray head, means for adjusting the orientation of the nozzle and grounding means for charge dissipation. This invention is for household use, it is directed to ensuring efficient coverage of the substrate and does not provide effective cleaning in itself.

U.S. Pat. No. 7,021,571 (Procter and Gamble, 2006) relates to a portable device for spraying a liquid at low pressure, said device comprising a spray arm and characterized in that the spray arm comprises at least one flat fan spray nozzle. Preferably, the liquid is a cleaning composition for treatment of carpets and other large fabric coverings, more preferably, a composition comprising surfactants. Also preferably, the portable device is electrically driven, and/or the spray arm is extendible and/or detachable from the device's main unit. This device is directed to ensure even coverage of the substrate e.g. carpets with the cleaning fluid and complete cleaning can be ensured only with a further downstream operation like vacuuming. It does not provide for cleaning in a single operation.

Thus there is a need in the art for providing for a convenient, preferably hand-held and/or portable device which can clean soiled fabric in a relatively short time while ensuring that there is minimal fabric damage.

It is thus an object of the present invention to provide for a process to clean soiled fabric with a hand held device in faster time as compared to some of the processes reported in the past.

It is another object of the present invention to provide for a process to clean soiled fabric which does not necessarily require an additional cleaning step like agitation in water, vacuuming or brushing.

It is yet another object of the present invention to provide for a process to clean soiled fabric which utilizes relatively lower amount of water for the cleaning operation, as compared to some of the prior art.

It is yet another object of the invention to provide for a device to clean soiled fabric which meets one or more of the above process objects in a simple, convenient, and/or easy to handle household device.

SUMMARY OF THE INVENTION

According to the first aspect of the present invention there is provided a process to clean a substrate comprising a step of subjecting the substrate to an air-water spray, generated using a spraying means comprising an air passage and a water passage, wherein air is greater than 90% by volume of the spray, the air velocity is greater than 80 m/s and wherein said air passage does not coaxially surround said water passage.

It is particularly preferred that the air and water do not come in contact inside said spraying means.

The preferred substrate is a fabric.

According to another aspect of the present invention there is provided a device to clean soiled fabric comprising a feed water container and an air compressor in fluid communication with a spray nozzle comprising an air passage and a water passage, said device capable of generating an air pressure in the range of 15 to 45 psia and an air velocity greater than 80 m/s at the exit of said nozzle; and the air is greater than 90 volume percent of said spray and wherein said air passage does not coaxially surround said water passage.

It is preferred that the spray nozzle of the device is hand held.

It is particularly preferred that the water to the device is gravity fed.

An external mix spray nozzle is especially preferred in the device of the invention.

DETAILED DESCRIPTION OF THE INVENTION

The process according to the present invention is directed to cleaning a substrate, preferably a porous substrate like fabrics. By fabrics is meant a woven, knitted or non-woven material made of synthetic or natural fibres or their mixtures. Examples include clothes for human outer and inner wear, carpets, upholstery, bed sheets. The process comprises the step of subjecting the surface of the substrate to an air-water spray generated using a spraying means e.g. a spray nozzle, wherein air is greater than 90% by volume of the spray, the air velocity is greater than 80 m/s and wherein the air passage does not co-axially surround the water passage. There are many ways in which this can be achieved. Not wishing to be bound by theory, it is believed that at the conditions of the spray i.e. at air velocities greater than 80 m/s and where air is greater than 90% by volume of the spray, it is important that the flowing air does not blanket the flowing water at the point of exit of air and water from their respective passages. Good results in cleaning are obtained when the flowing water blankets the flowing air or when the flowing air and flowing water impinge each other as they exit their respective passages in the spray nozzle. One way of achieving this is to use a spray nozzle where the water passage co-axially surrounds the air passage. It is also possible that the water passage surrounds the air passage, with the air passage being eccentrically positioned with respect to the axis of the water passage. Alternately, a highly suitable spray nozzle for enabling the invention requires that the water and the air do not come in contact inside the nozzle. By the phrase 'said air and said water do not come in contact inside the nozzle' is meant that the air and the water come in contact only outside the nozzle. Thus there is a separate outlet port for the air and the water. This is generally achieved using what are commonly called as external-mix nozzle. In this particular embodiment, it is possible that, although a separate outlet port is provided for air and the water, an outer sheath could be provided in the zone where the mixing of the air and the water occurs to form the spray.

Although the present invention is suitable for cleaning any substrate, it is particularly preferred for cleaning porous substrates e.g. fabrics. The present inventors have found that the unique combination of the mechanical feature of having the air passage not coaxially surround the water passage with the process conditions being that air is greater than 90% by volume of the spray and the air velocity is greater than 80 m/s is especially suitable for cleaning porous substrates like fabrics, which advantage is not as apparent when non-porous substrates like semiconductors are cleaned.

The volumetric flow rate of air throughout this specification is at the pressure and temperature conditions of 1 bar and 25° C.

Although the invention works in the absence of a surfactant, it is preferred that the water is mixed with a surfactant i.e. a surfactant solution is used as the cleaning liquid. The surfactant may be of any known class e.g. anionic, non-ionic, cationic, zwitterionic or amphoteric class. Examples of commonly known and used surfactants are given in the well-known textbooks "Surface Active Agents", Volume I by Schwartz and Perry and "Surface Active Agents and Detergents", Volume II by Schwartz, Perry and Berch. Although any concentration of surfactant may be used, suitable concentration is in the range of 0.5 to 3 grams per liter of the water.

When the substrate to be cleaned is a chemical stain on a fabric, e.g. those that occur when fabrics are stained with foods/beverages like tea, coffee, soup, ketchup etc., it is preferred that the stain is pre-treated with a bleaching agent before it is treated with the process of the invention.

An important criterion for the process of the invention is that the air comprises greater than 90 volume percent, more preferably greater than 98%, and optimally in the range of 99 to 99.95% by volume of the spray. It has been observed that when the volume percent of air is higher than 99.95% of the spray, the cleaning efficacy decreases dramatically. Although cleaning efficacy does not decrease when the volume percent of air is less than 90%, it is found that the amount of water that is used is so high that the specific advantages of the process of using low amount of water are not met, thereby making the process uneconomical. Air velocity at the exit of the spray greater than 80 m/s provides good cleaning. Better cleaning is obtained when the air velocity is greater than 130 m/s, further better cleaning at air velocity greater than 250 m/s and optimum cleaning when air velocity is in the range of 250 to 330 m/s which is close to sonic velocities. It has been found that cleaning is also very effective if supersonic velocities are used and suitable nozzles to achieve such velocities may be used in the present invention. Although any air and water flow rates may be used so long as the volume percent of air is greater than 90% of the spray, the process works well when the flow rate of air is in the range of 1 to 25 liters per minute, more preferably in the range of 5 to 10 liters per minute. Suitable and preferred air pressures for enabling the process of the invention are in the range of 15 to 45 psia at the air outlet port of the nozzle.

Although the present invention works well when the water is fed under any pressure, a good advantage of the present invention is that the process works well when the water is fed by gravity. This aspect makes the devices that are built based on this process very user friendly in that pumps which are generally power intensive are not required. Pumps are also very heavy and since they are not required in the present invention, the process of the present invention can lead to simple, light and hand-held devices. The flow rate of water is in the range of 1 to 1000 ml per minute, more preferably in the range of 5 to 350 ml per minute. This small amount of water required to achieve complete cleaning of the soils from the fabric is another important advantage of the invention.

The invention also provides for a device to clean soiled fabric. The device comprises (a) a feed water container and (b) an air compressor. The water fed is fed by gravity, and the air, pressurised by the air compressor, are fed to a hand-held spray nozzle. The desired spray nozzle is one where the air passage does not co-axially surround the water passage. The air has to have a pressure in the range of 15 to 45 psia, a velocity greater than 80 m/s at the exit of the nozzle and the air is greater than 90 volume percent of the spray. The spray nozzle is preferably hand held. Other possible configurations include the water container and the air compressor to be contained in a unit that is portable with one or more spray nozzles which may be fitted to a cleaning machine. Air velocity greater than 250 m/s are preferred. The container preferably comprises a surfactant solution. Very low power compressors can be used to achieve the above specifications, in the range of 0.05 to 1 HP.

According to a preferred aspect of the present invention the air fed to prepare the air-water spray is in a pulsed mode i.e. the air flow is controlled in an on-off fashion over time. Use of a suitable solenoid valve in the air line may be used to produce this flow profile in the air line.

The device may preferably comprise a means for controlled dosing of surfactant. A suitable controlled dosing system is a siphon and this can be adapted to be included in the device of the invention. The advantageous features of the process of the invention provides for a light and easy to use device that is portable, hand held and can be carried by one and all. Suitable devices of the invention have been fabricated by the inventors in weights from 1 to 3 kg.

When the substrate to be cleaned is pre-treated with a bleaching agent before it is treated with the device of the invention, such bleaching agent may be dispensed from a cartridge provided in the device itself. The dispensing unit for the bleach cartridge may be manually actuated or controlled by automatic timers programmed to actuate at a pre-determined time before the substrate is subjected to the air-water spray.

It is preferred that the outlet port for air and outlet port for water in the nozzle are offset from one another with respect to the substrate. Suitable offset distances are in the range of 0.5 to 5 mm. A more preferred option is to have the outlet port for water to be positioned away from the substrate relative to the outlet port for air. A highly preferred operation of the device is to have outlet port for air to be close to touching the surface of the substrate while the outlet port for water is positioned from 0.5 to 5 mm away from the surface. The cross-section of the outlet port for the air is preferably circular. The cross-section of the outlet port for the water is also preferably circular. When the cross-section of the outlet port for the water is circular, diameter is in the range of 0.25 to 3 mm. When the cross-section of the outlet port for the air is circular, the diameter is in the range of 0.5 to 2 mm. A further more preferred aspect of the device of the invention provides that the outlet port of the air and the water are not normal to the surface of the substrate but are positioned at an acute angle of incidence with respect to the surface of the substrate. An even more preferred aspect provides for the two angles of incidences to be different from each other. The angle of incidence of the outlet port of water is preferably higher than the angle of incidence of the air outlet port with respect to the substrate. The angle of incidence of the outlet port of water is in the range of 1 to 60° while the angle of incidence of the outlet port of air is in the range of 1 to 45°.

The invention will now be illustrated with reference to the following non-limiting embodiments and examples. The embodiments and examples are by way of illustration only and do not limit the scope of invention in any manner.

DETAILED DESCRIPTION OF THE DRAWINGS

Figure 1:
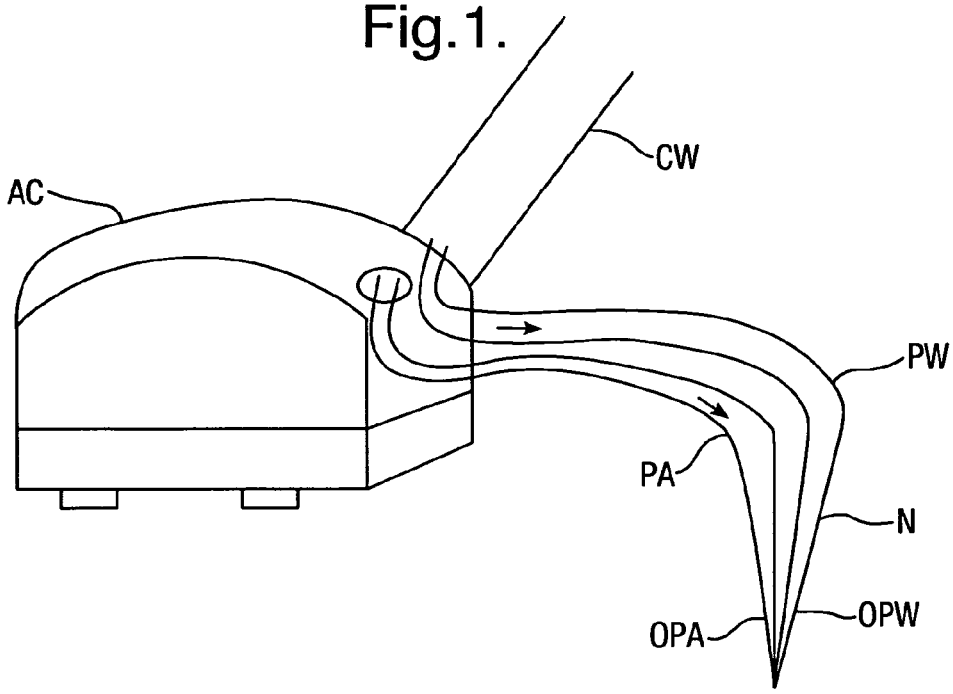
FIG. 1 is a schematic of a hand held embodiment of the device of the invention.

Referring to FIG. 1, the device of the invention is embodied as a hand held device for cleaning fabric. The device comprises an air compressor (AC) which weighs about 2 kg and runs on a motor that is rated at 75 W. The compressor is therefore light and easy to carry around like a household iron box for ironing clothes. The air compressor (AC) runs on electric power either from a wall outlet or from a set of batteries. A container for water (CW) is provided for feeding the water or surfactant solution to the device under gravity. The water is fed to the nozzle (N) through a tube (PW). Another tube (PA) feeds the compressed air from the air compressor (AC) to the nozzle (N). Air pressures of the order of 15 to 45 psia can be generated using this embodiment of the invention. The nozzle (N) is an external mix nozzle as is evident from FIG. 1. The air exits from the nozzle through outlet port for air (OPA) and the water exits through the outlet port for water (OPW).

Figure 2:
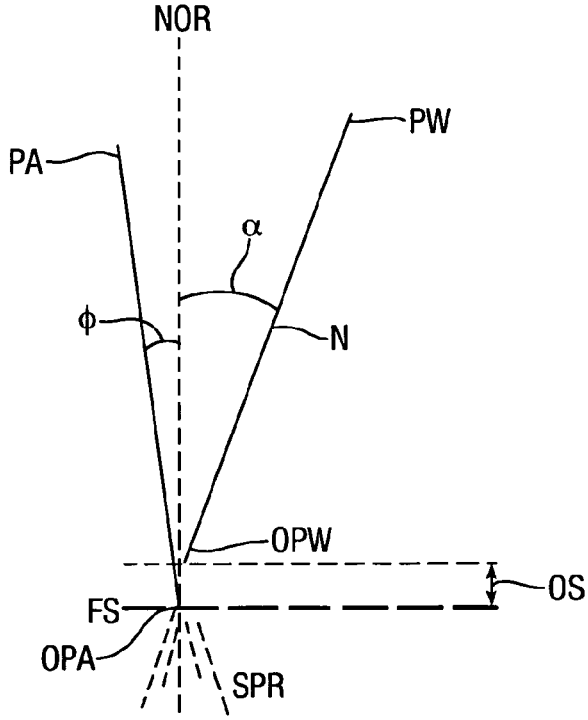
FIG. 2 is a schematic of a blown up view of the nozzle as per the embodiment of FIG. 1.

Referring to FIG. 2, the nozzle (N) has the outlet port for water (OPW) positioned away from the substrate relative to the outlet port for air (OPA), offset by a distance (OS). The angle of incidence of the outlet port for water with respect to the substrate (FS) is defined by the angle $\alpha$. The angle of incidence of the outlet port for air with respect to the substrate (FS) is defined by the angle $\phi$. The dashed line NOR represents an imaginary line which is normal to the surface of the substrate. As is apparent, in this embodiment of the nozzle the angle $\alpha$ is greater than the angle $\phi$.

When in use, water or surfactant solution is fed to the container for water (CW). The power to the air compressor is switched on thereby generating air pressure in the air compressor. Compressed air is fed through tube (PA) while water or surfactant solution is fed by gravity through tube (PW). The air and water mix outside the nozzle creating a spray (SPR), which is used to clean a soiled fabric.

The nozzle depicted in FIG. (3) was used to conduct the Examples 21 to 24.

The nozzle depicted in FIG. (4) was used to conduct the Examples 25 and 26.

Figure 5I:
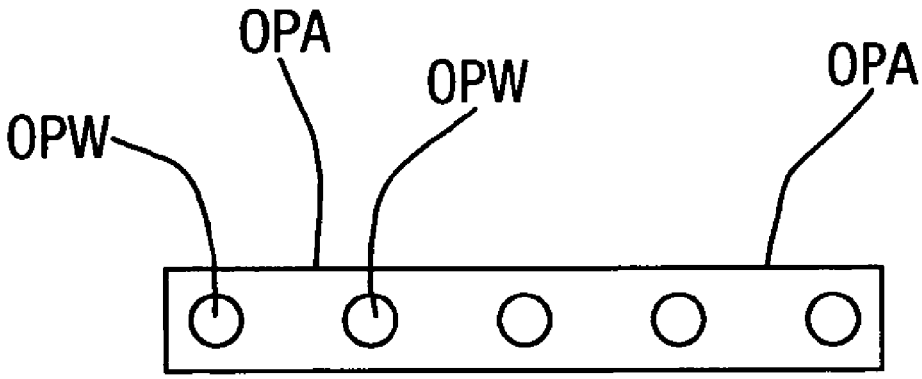
FIGS. 5(*i*) and 5(*ii*) are bottom sectional views of two other nozzle geometries which may be used in the present invention.
Figure 5:
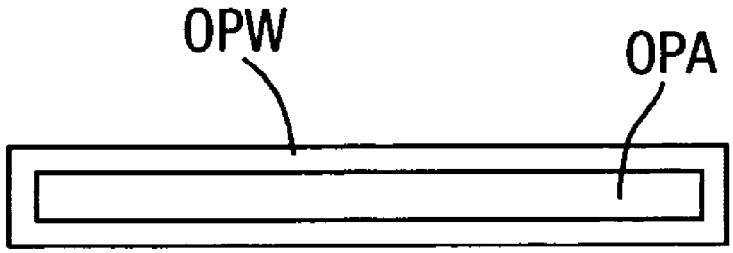

FIG. 5(*i*), and FIG. 5(*ii*) are the bottom sectional views of the outlet ports of two possible nozzles for use in the present invention. Referring to FIG. 5(*i*) the outlet ports for water (OPW) are depicted by the ports with circular cross-section and the outlet port for air (OPA) has a rectangular cross-section. In FIG. 5(*ii*), the outlet port for both air and water have a rectangular cross-section.

EXAMPLES

The invention will now be demonstrated with examples.

Example 1a to 8a

Effect of Air as Volume Percent of Spray

Various experiments were conducted using the device of FIGS. 1 and 2 where the flow rate of water was maintained at 5 ml/minute and the air flow rate was maintained at 5 liters/minute. The air velocity in all spray cleaning experiments was maintained 330 m/s. The air was generated using a 0.1 HP compressor (1500 rpm, 0.6 A) placed in a hand held unit as shown in FIG. 1. The air pressure generated by the compressor was 2 bar. The nozzle was an external mix nozzle with the water exit port offset from the air exit port by 2 mm. The water outlet port was positioned further away from the substrate as compared to the air outlet port. The angle of incidence of the water outlet port was 10° and the angle of incidence of the air outlet port was 5°. The volume percent of air with respect to the volume of the spray was varied as shown in Table-1.

Surfactant used was C12EO7 (Ethoxylated fatty alcohol having a carbon chain length of 12 and having 7 ethylene oxide groups). The device was used to clean WFK20D monitors having an initial reflectance of 43. The time of cleaning was maintained at 30 seconds for Example 1-7 which utilised a spray nozzle. Example 8 the test monitor was cleaned in a conventional tergo-to-meter (at 60 rpm) and the time of cleaning was 30 minutes. All the test monitors were rinsed in water for 2 minutes and air dried overnight.

The test monitors were measured for reflectance using a GRETAG MACBETH spectrophotometer. The difference in reflectance between uncleaned and cleaned fabric, was calculated and the ΔR values are reported in Table-1.

TABLE 1

| Example | Volume percent air | ΔR |
|---|---|---|
| 1 | 99.99 | 8.8 |
| 2 | 99.97 | 13.3 |
| 3 | 99.95 | 16.4 |
| 4 | 99.88 | 17.2 |
| 5 | 99.76 | 17.2 |
| 6 | 99.17 | 19.6 |
| 7 | 96.69 | 17.9 |
| 8 | Tergotometer cleaning | 12.1 |

An experiment at volume percent air of 89% was attempted keeping the rest of the process conditions the same. It was observed that it was very difficult to supply the amount of water required to achieve the desired air:water ratio and this makes operation at this condition impractical. Furthermore, operating at a volume percent air of 89% uses significantly large amounts of water/surfactant for which there is no practical benefit.

The data in table-1 indicates that there is good cleaning when the volume percent of air in the spray nozzle is higher than 90% with further improved cleaning when the volume percent of air is between 99 and 99.95%. This cleaning is achieved in as short a time as 30 seconds as compared to conventional simulated machine wash process (Example-8) which takes about 30 minutes. Further the amount of water required was 5-10 ml as compared to conventional process (Example-8) which requires about 100 ml.

Example 9 to 13

Effect of Air Velocity

Various experiments were conducted using the spray nozzle as used for Experiments 1 to 7. The flow rate of water was maintained at about 10 ml/minute and the air flow rate was maintained at 5 liters/minute. The air pressure was about 1.5 bar. The air velocity was varied as shown in Table-2. This spray used to clean WFK20D monitors having an initial reflectance of 43. The time of cleaning was maintained at 30 seconds. The test monitors were rinsed in water for 0.5 minutes and air-dried overnight.

The ΔR was measured as described for Examples 1-8 and the results are also summarised in Table-2. The ΔR results are the average of three readings. The results are compared to a tergotometer at 60 rpm, where the cleaning was carried out for 30 minutes at the same surfactant concentration.

TABLE 2

| Example | Air velocity, m/s | ΔR |
|---|---|---|
| 9 | 132 | 11.2 |
| 10 | 181 | 11.6 |
| 11 | 266 | 15.4 |
| 12 | 327 | 17.7 |
| 13 | Tergotometer | 12.1 |

The data in Table-2 indicates that good cleaning is obtained at air velocities higher than 125 m/s and further improved cleaning is obtained at air velocities higher than 250 m/s.

Examples 14 to 21

Effect of Positioning of the Air and Water Outlet Ports

Experiments were conducted with various configurations of the air and water outlet ports with respect to each other. The configurations are explained in Table-3. Examples 14 to 20 were carried out using external mix nozzles required as per the invention. Example 21 was carried out using a nozzle where water was atomised by air inside the nozzle which is a configuration out the scope of the present invention. The cleaning in terms of AR obtained for WFK20D fabrics cleaned using the device of the invention is also shown in Table-3. The process conditions were:

Surfactant used: C12EO7; Surfactant concentration: 3 gpl

Air velocity: 330 m/s; Volume percent of air with respect to spray: 99%

Water flow rate: 7 ml/min; Air pressure: 1.5 bar

TABLE 3

| Example | Air outlet port | Water outlet Port | Offset, mm | ΔR |
|---|---|---|---|---|
| 14 | Closer to substrate | Away from substrate | 1 | 15.1 |
| 15 | Away from substrate | Closer to substrate | 1 | 14.0 |
| 16 | Closer to substrate | Away from substrate | 3 | 13.9 |
| 17 | Away from substrate | Closer to substrate | 3 | 13.1 |

TABLE 3-continued

| Example | Air outlet port | Water outlet Port | Offset, mm | ΔR |
|---|---|---|---|---|
| 18 | Closer to substrate | Away from substrate | 5 | 13.5 |
| 19 | Away from substrate | Closer to substrate | 5 | 11.0 |
| 20 | Together with water outlet port | Together with water outlet port | — | 10.6 |

The data in table-3 indicates that superior cleaning is obtained when the air outlet port and water outlet ports are offset from each other (Examples 14 to 20) as compared to when they are positioned together. Further superior cleaning is obtained when the air outlet port is positioned closer to the substrate as compared to the water outlet port.

Examples 21 to 24

Figure 3I:
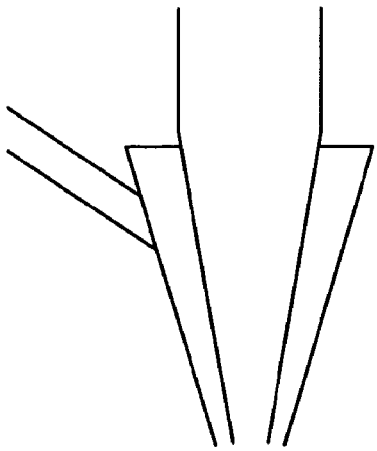
FIG. 3 is a nozzle as per the invention with FIG. 3(*i*) representing the front view and FIG. 3(*ii*) representing the bottom view.
Figure 3:
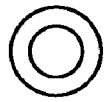

Cleaning Efficiency Using a Co-Axial Nozzle Under Different Operating Conditions Experiments were done on cleaning various WFK20D fabrics using the nozzle configurations as shown in FIGS. 3(*i*) and 3(*ii*). The process conditions are summarised in Table-4. The cleaning in terms of ΔR as an average over three fabrics is also shown in Table-4. The process conditions were:
Surfactant used: C12EO7
Surfactant concentration: 3 gpl
Air velocity: 330 m/s
Volume percent of air with respect to spray: 99%
Water flow rate: 7 ml/min.
Air pressure: 1.5 bar
Time of cleaning: 30 seconds

TABLE 4

| Example | Passage of air and water | Water pressure, Psig | ΔR |
|---|---|---|---|
| 21 | a | Gravity fed | 21.9 |
| 22 | b | Gravity fed | 16.5 |
| 23 | a | 20 | 24.9 |
| 24 | b | 20 | 17.8 |

a: Water passage coaxially surrounding the air passage.
b: Air passage coaxially surrounding the water passage.

The data in Table-4 indicates that the nozzle having the configuration where the air passage axially surrounds the water passage provides for poorer cleaning efficiency as compared to other configurations.

Examples 25, 26

Cleaning Efficiency Using Another Co-Axial Nozzle Configuration

Figure 4I:
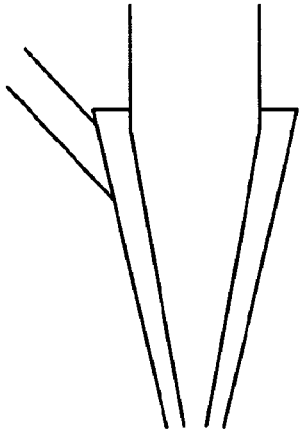
FIG. 4 is another nozzle as per the invention with FIG. 4(*i*) representing the front view and FIG. 4(*ii*) representing the bottom view.
Figure 4:
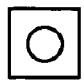

Experiments were done on cleaning various WFK20D fabrics using the nozzle configurations as shown in FIG. 4. In FIG. 4, FIG. 4(*i*) represents the front view and FIG. 4(*ii*) represents the bottom view. The process conditions are summarised in Table-5. The cleaning in terms of ΔR as an average over three fabrics is also shown in Table-5. The process conditions were:
Surfactant used: C12EO7
Surfactant concentration: 3 gpl
Air velocity: 330 m/s Volume percent of air with respect to spray: 99%
Water flow rate: 7 ml/min.
Air pressure: 2 bar
Time of cleaning: 30 seconds

TABLE 5

| Example | Passage of ar and water | Water pressure, Psig | ΔR |
|---|---|---|---|
| 25 | a | Gravity fed | 19.9 |
| 26 | b | Gravity fed | 13.4 |

a: Water passage coaxially surrounding the air passage.
b: Air passage coaxially surrounding the water passage.

The data in Table-5 indicates that even for a different nozzle geometry, the configuration where the air passage axially surrounds the water passage provides for poorer cleaning efficiency as compared to other configuration.

Example 27 & 28

Comparison Between Cleaning Using Continuous Air-Water Spray and Pulsed Mode

Example 27

Cleaning was carried out on iron-oxide soiled cotton fabrics (R=37) using a nozzle as per the invention (Example 14) for a total time of 5 minutes with the air-water spray in a continuous fashion. The following were the nozzle specifications:
Air nozzle diameter=0.5 mm
Water nozzle diameter=0.5 mm
Surfactant used in the water was 3 grams per liter non-ionic surfactant C12EO7.

Example 28

Experiment was carried out as per Example-27 except that the air was in a pulsed mode with open time of 300 milliseconds followed by closed time of 300 milliseconds. The fabric was similarly soiled (R=37).
The data on four such fabrics cleaned using the process of Example 27 and 28 is presented in Table-6.

TABLE 6

| Sample Nos | Reflectance Example 27 | Reflectance Example 28 |
|---|---|---|
| 1 | 59.9 | 63.1 |
| 2 | 62.0 | 63.7 |
| 3 | 57.5 | 60.5 |
| 4 | 58.7 | 61.2 |

The data in Table-6 indicates that the cleaning as per a preferred aspect of the invention comprising pulsed air flow produces better cleaning as compared to the basic aspect of the invention where the air flow is continuous.

Example-29

Trials were conducted in four cities across India and China. About 80 consumers brought in their soiled garments from home and cleaned them using the device as per the invention. They were asked to comment on the device in comparison to their usual way of cleaning fabrics. In summary their comments were as follows: Good cleaning, short time, less effort, less water usage and friendly on hands.

The present invention thus provides for a process and a device to clean soiled fabric in faster time as compared to some of the processes reported in the past. This can be achieved using a device that does not require an additional cleaning step like agitation in water, vacuuming or brushing. The invention utilizes relatively lower amount of water for the cleaning operation, and it does all of the above in a simple, convenient, and/or easy to handle household device.

The invention claimed is:

1. A process to clean a substrate comprising a step of subjecting the substrate to an air-water spray, generated using a nozzle (N) comprising an air passage (PA) and a water passage (PW), wherein air is greater than 90% and up to 99.95% by volume of the spray, the air velocity is greater than 80 m/s and wherein outlet port for air (OPA) and outlet port for water (OPW) in the nozzle (N) are offset from one another with respect to the substrate; characterised in that a. the outlet port for water (OPW) is positioned away from the surface of the substrate (FS) relative to the outlet port for air (OPA);

b. the offset distance between the outlet port for air and the outlet port for water is in a range of 0.5 to 5 mm; and c. the air pressure at the exit of the nozzle is in the range of 15-45 psia.

2. A process as claimed in claim 1 wherein air and water do not come in contact inside said air passage (PA) and said water passage (PW).

3. A process as claimed in claim 1 wherein said water is mixed with a surfactant.

4. A process as claimed in claim 1 wherein air is greater than 98% by volume of the spray.

5. A process as claimed in claim 1 wherein air velocity is greater than 130 m/s.

6. A process as claimed in claim 1 wherein said substrate is a fabric.

7. A process as claimed in claim 1 wherein said air is fed in a pulsed mode.

* * * * *